United States Patent [19]

Puri et al.

[11] Patent Number: 5,014,785

[45] **Date of Patent: * May 14, 1991**

[54] METHANE PRODUCTION FROM CARBONACEOUS SUBTERRANEAN FORMATIONS

[75] Inventors: Rajen Puri, Tulsa, Okla.; Michael H. Stein, Houston, Tex.

[73] Assignee: Amoco Corporation, Chicago, Ill.

[ * ] Notice: The portion of the term of this patent subsequent to Nov. 28, 2006 has been disclaimed.

[21] Appl. No.: 391,212

[22] Filed: Aug. 8, 1989

Related U.S. Application Data

[63] Continuation-in-part of Ser. No. 249,810, Sep. 27, 1988, Pat. No. 4,883,122.

[51] Int. Cl.[5] ..... E21B 43/16; E21B 43/24; E21B 43/30; E21B 43/40

[52] U.S. Cl. ..... 166/263; 166/245; 166/266; 166/272

[58] Field of Search ..... 299/10, 14, 7, 12, 4; 166/263, 268, 271, 272, 266, 267, 245, 303, 305.1; 48/197 R, 210

[56] References Cited

U.S. PATENT DOCUMENTS

| | | | |
|---|---|---|---|
| 4,010,800 | 3/1977 | Terry | 166/272 X |
| 4,043,395 | 8/1977 | Every et al. | 166/263 |
| 4,130,164 | 12/1978 | Datta | 166/266 X |
| 4,391,327 | 7/1983 | De Carlo | 299/12 X |
| 4,400,034 | 8/1983 | Chew | 299/5 |
| 4,446,921 | 5/1984 | Coenen et al. | 166/266 X |
| 4,448,252 | 5/1984 | Stoddard et al. | 166/268 X |
| 4,544,037 | 10/1985 | Terry | 299/12 X |
| 4,662,439 | 5/1987 | Puri | 166/272 X |
| 4,756,367 | 7/1988 | Puri et al. | 166/263 |
| 4,883,122 | 11/1989 | Puri et al. | 166/272 X |

OTHER PUBLICATIONS

Reznik et al., "An Analysis of the Effect of $CO_2$ Injection on the Recovery of In-Situ Methane from Bituminous Coal: An Experimental Simulation", (10/84).

Gunther, "Etude de la liaison gaz-charbon", Rev. Ind. Min. 47, 693-707 (10/65).

*Primary Examiner*—Stephen J. Novosad

*Attorney, Agent, or Firm*—Scott H. Brown; Fred E. Hook

[57] ABSTRACT

A method of producing methane by injecting inert gas, such as nitrogen, through an injection well into a solid carbonaceous subterranean formation (e.g., coal) and recovering methane from a production well(s). Methane desorption is achieved by reduction in methane partial pressure rather than by reduction in total pressure alone.

32 Claims, 6 Drawing Sheets

METHANE RECOVERY RATE

N2 INJECTION ACCELERATES METHANE PRODUCTION

N2 INJECTION INCREASES RECOVERABLE HYDROCARBON RESERVES

PRODUCED GAS IS A MIXTURE OF NITROGEN AND METHANE

METHANE PRODUCTION FROM CARBONACEOUS SUBTERRANEAN FORMATIONS

This Application is a Continuation-In-Part of Ser. No. 249,810filed Sept. 27, 1988now U.S. Pat. No. 4,883,122.

FIELD OF THE INVENTION

The present invention is a method of producing methane from a solid carbonaceous subterranean formation. More specifically, the invention is a method of producing methane from a solid carbonaceous subterranean formation by injecting an inert gas through an injection well into the solid carbonaceous subterranean formation to strip methane from the carbonaceous materials in the formation and sweep the produced gases into a production well.

BACKGROUND OF THE INVENTION

During the conversion of peat to coal, methane gas is produced as a result of thermal and biogenic processes. Because of the mutual attraction between the coal surface and the methane molecules, a large amount of methane can remain trapped in-situ as gas adhered to the organic matter (i.e., carbonaceous materials) in the formation. The reserves of such "methane" in the United States and around the world are huge. Most of the reserves are found in coal, but significant reserves are found in gas shales and other solid carbonaceous subterranean formations.

Conventional methane recovery methods are based on reservoir pressure depletion strategy; that is, methane is desorbed from the carbonaceous surfaces by reducing the reservoir pressure. While this method of methane production is simple, it is not efficient. Loss of reservoir pressure deprives the pressure depletion process of the driving force necessary to flow methane gas to the wellbores. Consequently, the gas production rate from a well is adversely affected by the reduction in reservoir pressure.

Another method of recovering methane is by injecting into the solid carbonaceous subterranean formation a gas, such as $CO_2$, having a higher affinity for coal or other carbonaceous material than the adsorbed methane, thereby establishing a competitive adsorption/-desorption process. In this process, the $CO_2$ displaces methane from the surface of coal, thereby freeing the methane so that it can flow to a wellbore and be recovered. This method is disclosed in the reference by A. A. Reznik, P. K. Singh, and W. L. Foley, "An Analysis of the Effect of $CO_2$ Injection on the Recovery of In-Situ Methane from Bituminous Coal: An Experimental Simulation," *Society of Petroleum Engineers Journal*, October 1984. The problem with this method is the large volume of $CO_2$ that must be injected into the solid carbonaceous subterranean formation in order to exchange sites with methane. In most instances, such an amount would be uneconomical. This reference reports that mixing even small amounts of nitrogen gas with $CO_2$ significantly reduces the effectiveness of displacement desorption of methane by $CO_2$.

There is a need for a method of producing methane from coal and other solid carbonaceous subterranean formations that accelerates the production rate and improves recoverable gas reserves economically.

SUMMARY OF THE INVENTION

The present invention overcomes the foregoing deficiencies and meets the above-described needs. The present invention is a method for producing methane from a solid carbonaceous subterranean formation penetrated by at least one producing well. The method comprises injecting an inert gas through the injection well and into the solid carbonaceous subterranean formation, and producing the inert gas and the methane from the production well. Coalbed methane recovery is accelerated and substantial improvement is made in the net recoverable reserves.

DETAILED DESCRIPTION OF THE INVENTION

Figure 1:
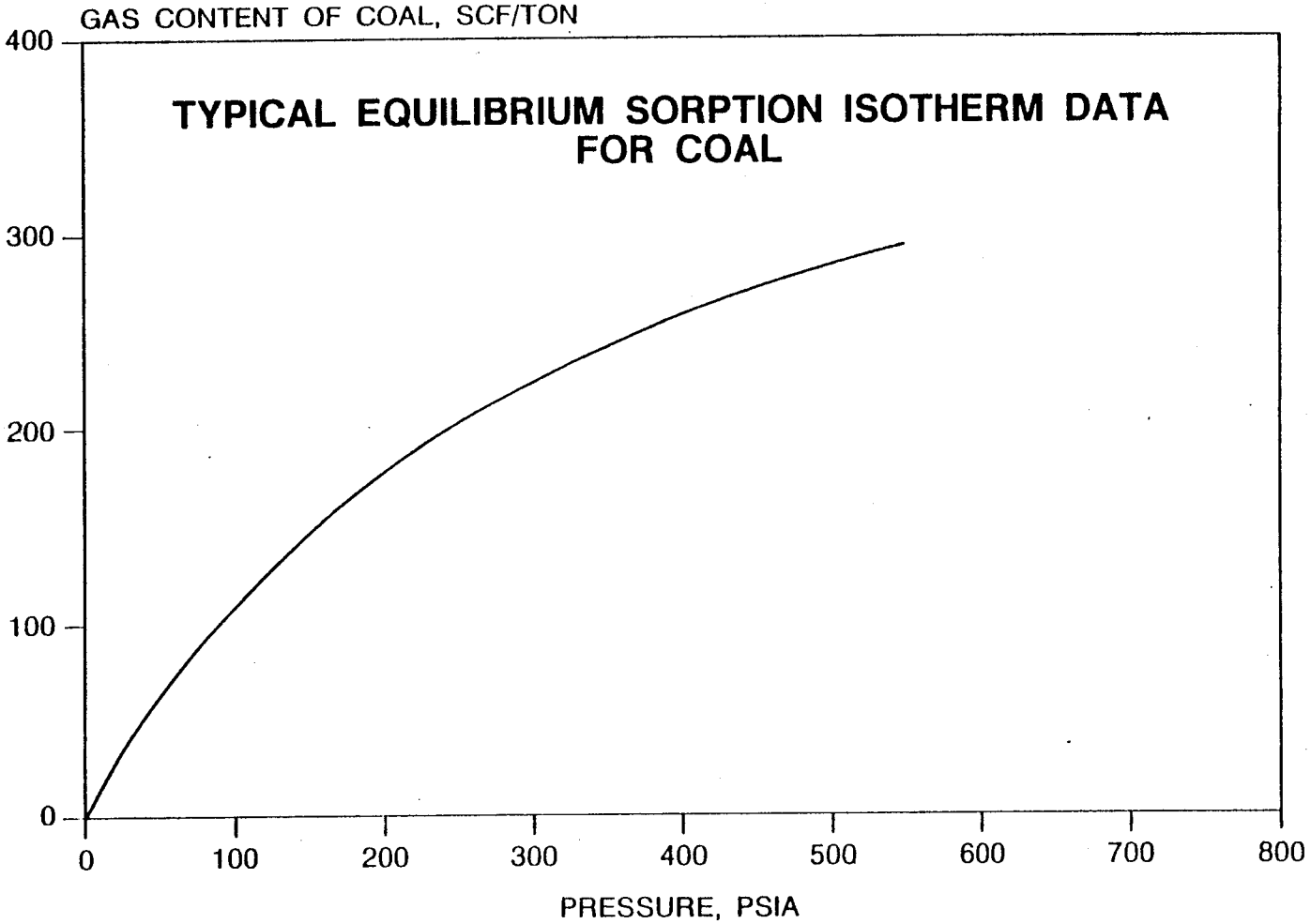
FIG. 1 is a graphical representation of a sorption isotherm illustrating the relationship between the reservoir pressure of a coal seam and the gas content of the coal. The sorption isotherm is a representation of the maximum methane holding capacity of coal as a function of pressure at a fixed temperature.
Figure 2:
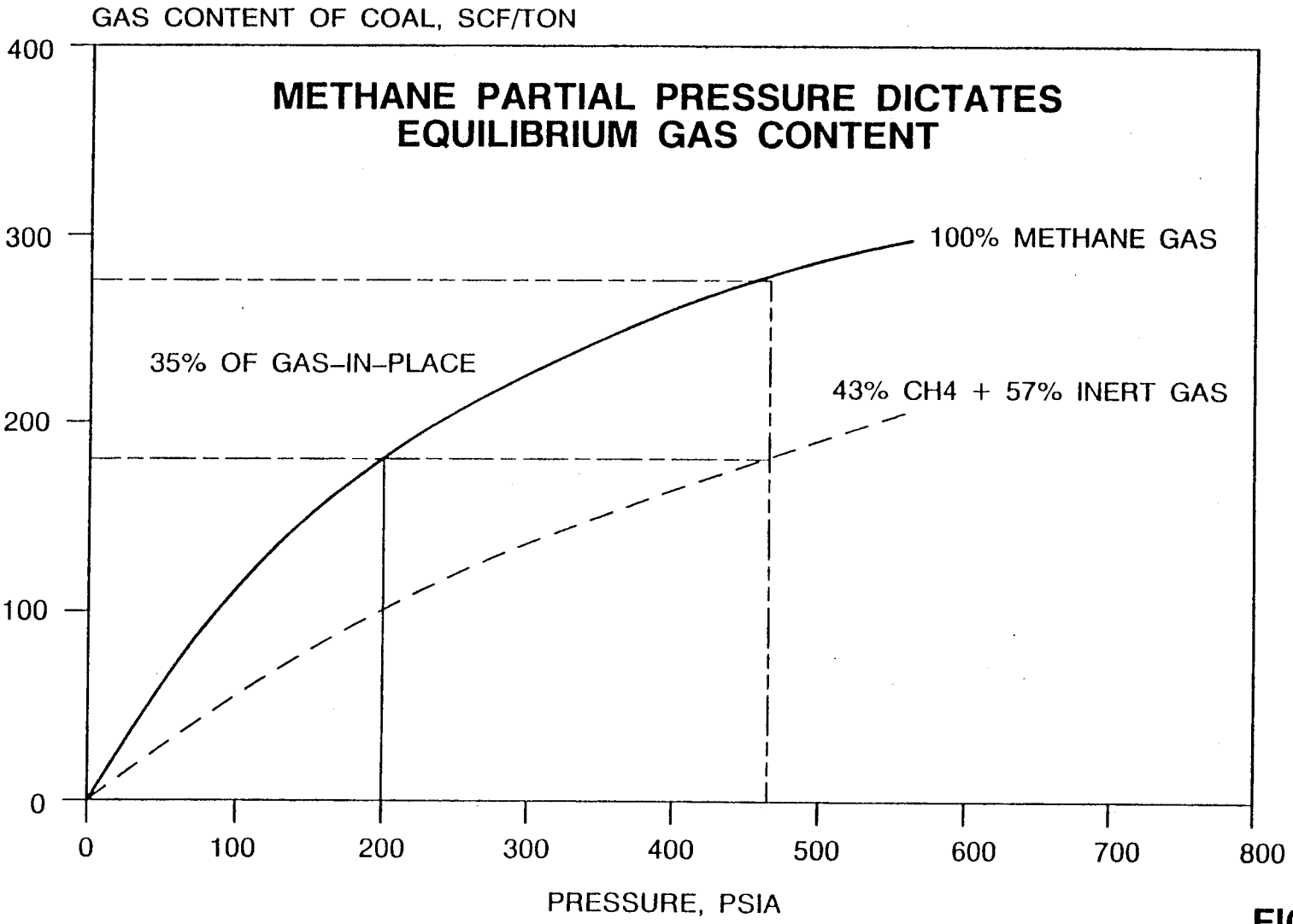
FIG. 2 is a graphical representation of a sorption isotherm of a coal sample in the presence of an inert gas.

The desorption of methane from the carbonaceous surface of the formation is controlled by the partial pressure of methane gas rather than the total system pressure. Therefore, methane is desorbed as a result of reduction in methane partial pressure. The methane recovery from a solid carbonaceous subterranean formation can be accelerated and enhanced by the continuous injection of an inert gas into the solid carbonaceous subterranean formation. While the total reservoir pressure is maintained, if not increased, the partial pressure of methane is reduced. The term "inert gas" defines a gas that (i) does not react with the coal or other carbonaceous material in the formation under conditions of use (i.e., the standard meaning for "inert") and (ii) that does not significantly adsorb to the coal or solid carbonaceous subterranean formation. Carbon dioxide and gaseous mixtures, such as flue gas, that contain carbon dioxide as a significant constituent do not meet the later criteria. It is known that coal has a higher affinity for carbon dioxide than for adsorbed methane. It is also known that coal has a lower affinity for the inert gases used herein than for adsorbed methane. See, for example, the French paper "Etude de la liaison gaz-charbon" by J. Gunther, Rev. Ind. Min. 47, 693–708 (October, 1965) and also the disclosure in USP Every (for $CO_2$). Examples of inert gases include nitrogen, helium, argon, air and the like. Nitrogen is preferred based on current commercial availability and price. FIG. 2 shows the equilibrium sorption isotherm of a coal sample in the presence of an inert gas. As illustrated, 35% of the gas in place can be recovered from coal by either reducing the total pressure from 465 psi to 200 psi or by diluting the free methane gas concentration in coal with an inert gas so as to reach an equilibrium value of 43% methane and 57% inert gas without any change in the total pressure.

The use of inert gas to desorb methane is economically and technically feasible primarily because of the low effective porosity of the carbonaceous formation. For example, the effective porosity of coal is in the order of 1%. Injection of a relatively small amount of inert gas into the solid carbonaceous portion of the formation causes a large reduction in the partial pressure of free methane gas in the treated carbonaceous portion of the formation, such as the cleat system of a coalbed. Consequently, methane is desorbed from the carbonaceous materials in the formation until a new equilibrium is reached, as per the sorption isotherm. The mixture of methane and inert gas flows across and through the solid carbonaceous subterranean formation along with water until it is recovered at the surface by means of producing wells. The produced gas is separated from water and recovered using known separation methods. Methane is separated from the inert gas also using known separation methods. The methane is then marketed, the inert gas can be recycled. Economics of the methods are enhanced by recycling the inert gas.

The novel inert gas stripping method of the present invention can be further improved by heating the inert gas before it is injected into the solid carbonaceous subterranean formation.

The injection pressure of the inert gas should preferably be lower than the fracture parting pressure of the solid carbonaceous subterranean formation but should be higher than the initial reservoir pressure. Maintenance of a constant injection pressure is also desirable, although not necessary.

The present invention requires at least one injection well and at least one production well. The number and location of the injection and production wells can be varied and will usually be determined after reservoir engineering and economics of a specific field project have been evaluated.

During the present process, the solid carbonaceous subterranean formation is dewatered, but reservoir pressure is not lost. This is an important advantage because maintenance of reservoir pressure in a methane field also helps reduce water migration from the surrounding aquifers. This is particularly advantageous in solid carbonaceous subterranean formations with high permeability and effective cleat porosity. Over the life of the degas project, the amount of water that is recovered from and disposed of can be reduced because of the reduced water migration in the field.

Inert gas injection can also be conducted in existing fields that have been on pressure depletion for a period of time prior to such injection. In this method, methane is produced through at least a first and second well. Then such production is ceased in the first well and inert gas in injected through the first well into the solid carbonaceous subterranean formation. The inert gas and methane is then produced from the second well.

EXAMPLE

Figure 3A:
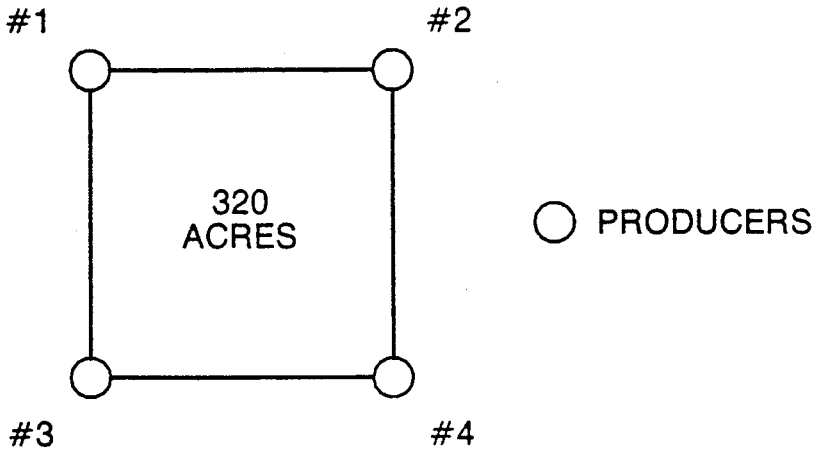
FIG. 3A is a plan view of a 4-spot repeating well pattern for a base case of the Example.
Figure 3B:
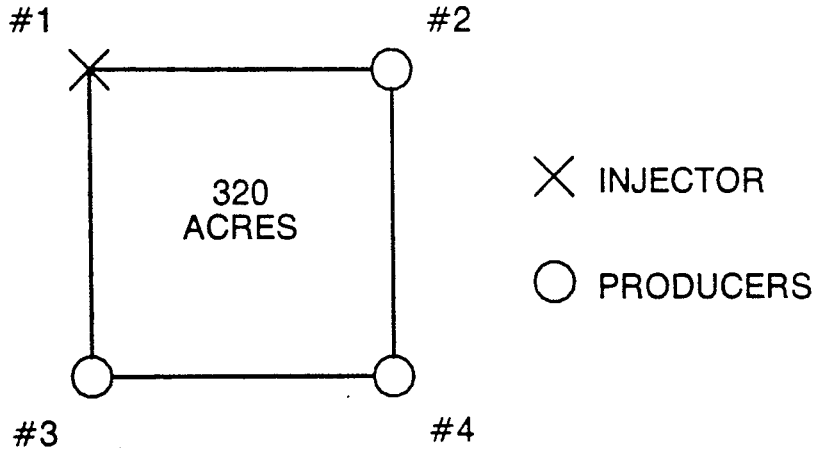
FIG. 3B is a plan view of a 4-spot repeating well pattern for an inert case of the Example.

Four wells are drilled in a 320 acre square in a repeating well pattern (as shown in FIG. 3A and 3B) and produced at total gas rates of approximately 1200 thousand standard cubic feet per day for a period of five years (base case as shown in FIG. 3A) using a reservoir pressure depletion technique. At that time, one of the wells (No. 1 as shown in FIG. 3B) is converted into an injection well and nitrogen is injected through this well and into the solid carbonaceous subterranean formation for the next twenty years.

Figure 4:
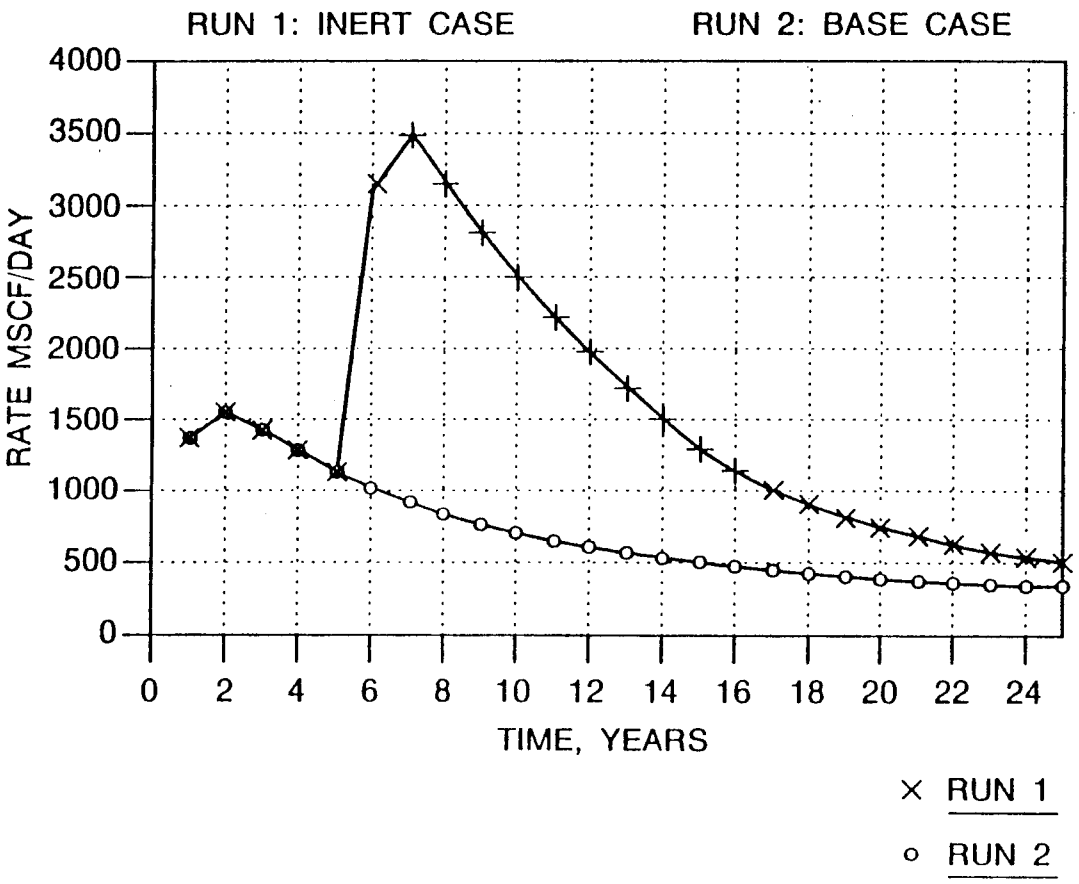
FIG. 4 is a graphical representation of the methane production rate versus time for the four spot repeating well pattern.
Figure 5:
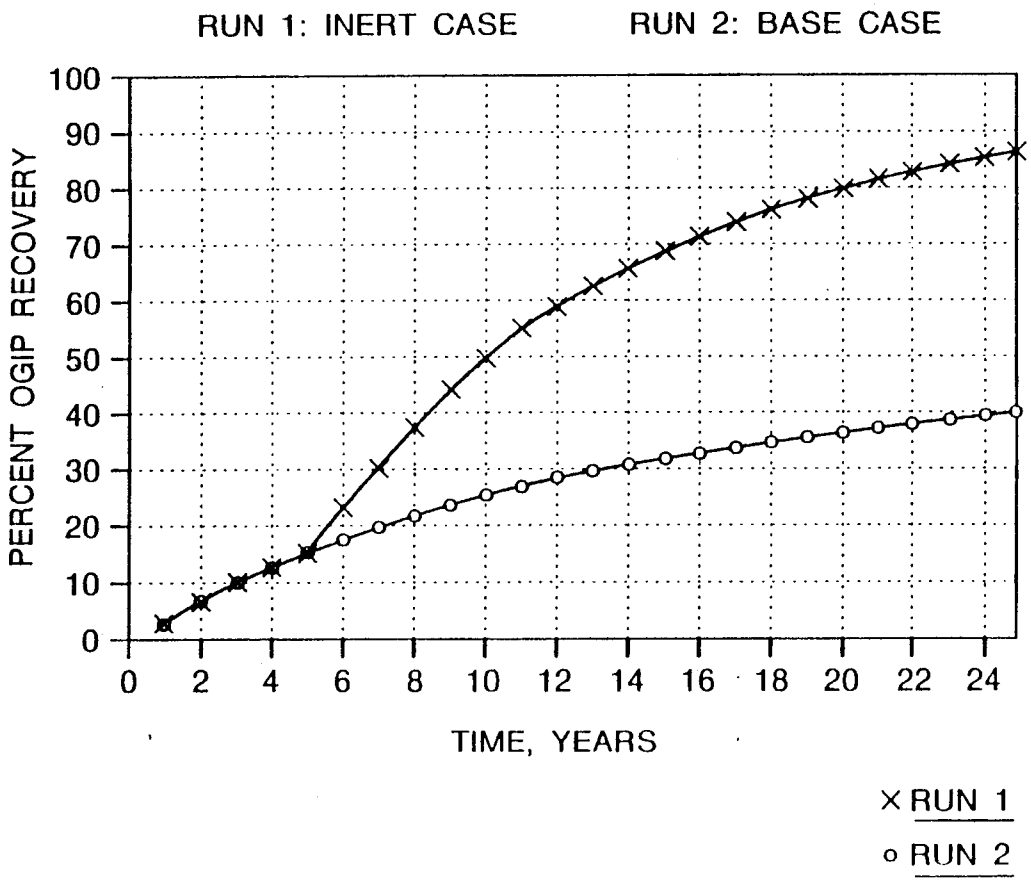
FIG. 5 is a graphical representation of the original gas in place recovered versus time for the four spot repeating well pattern.
Figure 6:
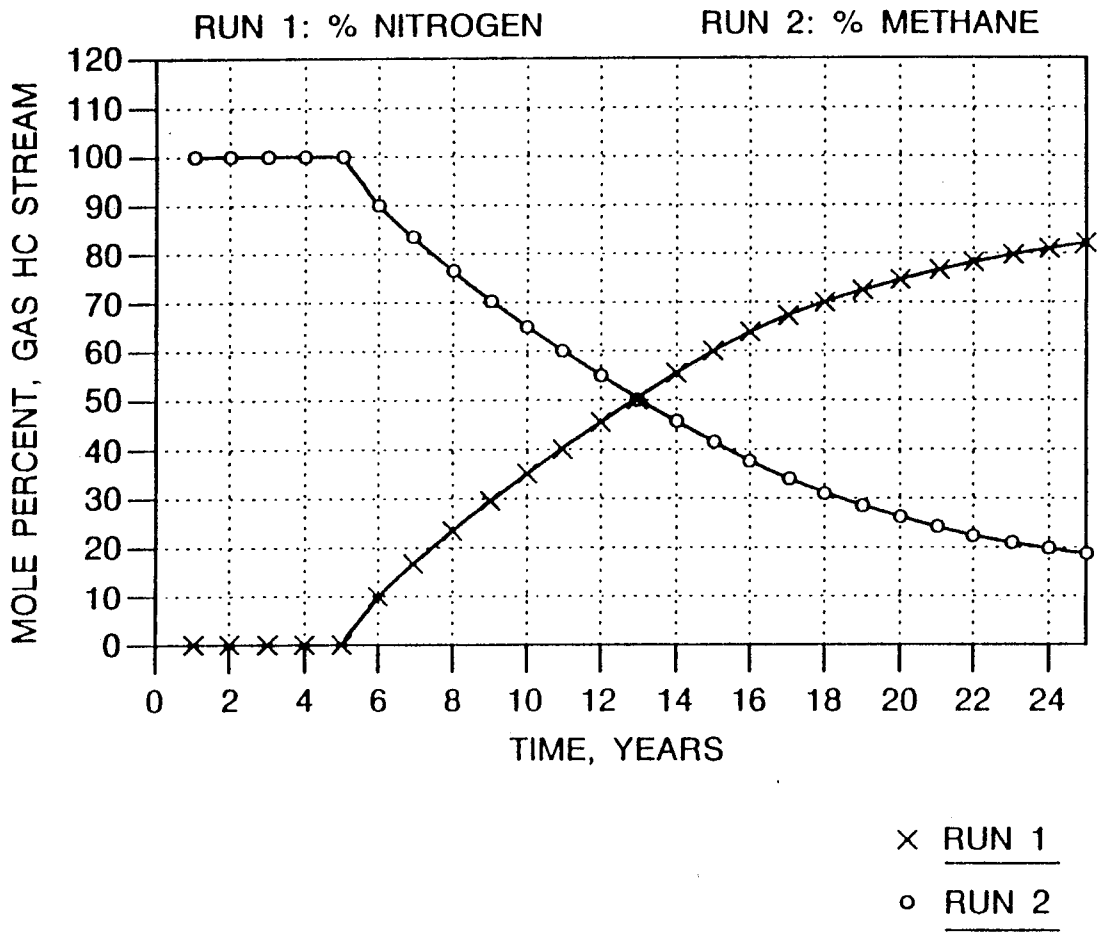
FIG. 6 is a graphical representation of the mole percent of gas produced versus time for the four spot repeating well pattern.

FIG. 4 shows the gas production rates for the four producing wells of the base case and for the three producing wells during $N_2$ injection. As shown, methane recovery from the field increases substantially when $N_2$ injection is initiated. FIG. 5 shows the percent of original gas in place recovered for the base case and for the three producing wells during $N_2$ injection. As illustrated, the injection of inert gas in the field increases the net recoverable reserves of methane gas by more than a factor of 2. The composition of the produced gas is shown as a function of time in FIG. 6.

This example shows that inert gas injection in coal is of considerable value in, accelerating and enhancing methane recovery from coal or solid carbonaceous subterranean formation.

The present invention has been described in particular relationship to the attached drawings. However, it should be understood that further modifications, apart from those shown or suggested herein, can be made within the scope and spirit of the present invention.

What is claimed is:

1. A method for producing methane from a solid carbonaceous subterranean formation penetrated by at least one injection well and at least one production well, the method of production comprising the steps of:

(a) injecting a gas, consisting essentially of an inert gas, through the injection well and into the solid carbonaceous subterranean formation; and (b) producing a composition comprising inert gas and methane from the production well.

2. A method of claim 1 wherein the inert gas is selected from the group consisting of nitrogen, helium, argon and air.

3. A method of claim 1 wherein the inert gas is nitrogen.

4. A method of claim 1 wherein the injection pressure is maintained substantially constant.

5. A method of claim 1 wherein inert gas is injected at a pressure less than reservoir parting pressure but greater than initial reservoir pressure.

6. A method of claim 1 wherein the methane produced in step (b) is separated from produced gases.

7. A method of claim 1 wherein water is produced in step (b) and separated from the inert gas and the methane.

8. A method of claim 1 and further including the steps of separating inert gas from the composition, and recycling the separated inert gas by reinjecting the separated inert gas into the solid carbonaceous subterranean formation.

9. A method of claim 1 wherein carbonaceous material within the solid carbonaceous subterranean formation comprises coal.

10. A method for producing methane from a solid carbonaceous subterranean formation penetrated by at least a first well and a second well, the method of production comprising the steps of:

(a) producing methane from a solid carbonaceous subterranean formation from the first well and second well;

(b) ceasing the production of methane from the first well and injecting a gas, consisting essentially of an inert gas, through the first well into the solid carbonaceous subterranean formation; and (c) producing a composition comprising inert gas and methane from a second well.

11. A method of claim 10 wherein the inert gas is selected from the group consisting of nitrogen, helium, argon and air.

12. A method of claim 10 wherein the inert gas is nitrogen.

13. A method of claim 10 wherein the injection pressure is maintained substantially constant.

14. A method of claim 10 wherein the inert gas is injected at a pressure less than reservoir parting pressure but greater than initial reservoir pressure.

15. A method of claim 10 wherein the inert gas produced in step (b) is separated from the methane.

16. A method of claim 10 wherein water is produced in steps (a) and (c) and separated from produced gases.

17. A method of claim 10 wherein carbonaceous material within the solid carbonaceous subterranean formation comprises coal.

18. A method of recovering methane from a solid carbonaceous subterranean formation penetrated by an injection well and a production well, the method comprising:

(a) injecting inert gas through the injection well into the solid carbonaceous subterranean formation at a pressure higher than reservoir pressure prior to the initiation of inert gas injection;

(b) recovering inert gas and methane through the production well;

(c) separating inert gas from recovered methane; and (d) recycling the separated inert gas by reinjecting the separated inert gas into the solid carbonaceous subterranean formation.

19. A method of claim 18 wherein carbonaceous material within the solid carbonaceous subterranean formation comprises coal.

20. A method of claim 18 wherein the inert gas consists essentially of nitrogen.

21. A method of claim 18 further comprising the steps of heating inert gas above an initial temperature of the subterranean formation prior to the inert gas being injected into the injection well.

22. A method of recovering methane from a solid carbonaceous subterranean formation, penetrated by an injection well and a production well, the method comprising:

(a) injecting gas that desorbs methane from solid carbonaceous material into the subterranean formation through the injection well at a pressure higher than reservoir pressure prior to the initiation of gas injection and lower than reservoir parting pressure; and (b) recovering gas that desorbs methane and methane through the production well while maintaining or increasing reservoir pressure as compared to reservoir pressure prior to the initiation of injection of the gas that desorbs methane.

23. A method of claim 22 wherein gas that desorbs methane injected in step (a) comprises at least one gas selected from the group consisting of nitrogen, helium, argon and air.

24. A method of claim 22 wherein gas that desorbs methane consists essentially of nitrogen.

25. A method of claim 24 wherein carbonaceous material within the solid carbonaceous subterranean formation comprises coal.

26. A method of claim 22 wherein gas that desorbs methane comprises a gas that does not react with carbonaceous material in the solid carbonaceous subterranean formation under conditions of use.

27. A method of claim 22 wherein gas that desorbs methane comprises a gas that does not significantly adsorb to carbonaceous material in the solid carbonaceous subterranean formation.

28. A method of claim 22 wherein gas that desorbs methane comprises a gas that (a) does not react with carbonaceous material in the solid carbonaceous subterranean formation under conditions of use, and (b) does not significantly adsorb to carbonaceous material in the solid carbonaceous subterranean formation.

29. A method of recovering methane from a solid carbonaceous subterranean formation, penetrated by an injection well and a production well, the method comprising:

(a) injecting inert gas into the subterranean formation through the injection well at a pressure higher than reservoir pressure prior to the initiation of inert gas injection and lower than reservoir parting pressure;

(b) recovering inert gas and methane through the production well while maintaining or increasing reservoir pressure as compared to reservoir pressure prior to step (a);

(c) separating recovered inert gas from recovered methane; and (d) recycling the separated inert gas by injection into the solid carbonaceous subterranean formation.

30. A method of claim 29 wherein carbonaceous material within the solid carbonaceous subterranean formation comprises coal.

31. A method of claim 30 wherein inert gas injected in step (a) comprises at least one gas selected from the group consisting of nitrogen, helium, argon and air.

32. A method of claim 31 wherein inert gas consists essentially of nitrogen.

* * * * *